US012213581B2

(12) United States Patent
Briscoe

(10) Patent No.: US 12,213,581 B2
(45) Date of Patent: Feb. 4, 2025

(54) MULTI LIQUID DISPENSING BRUSH

(71) Applicant: Quintina Briscoe, Waldorf, MD (US)

(72) Inventor: Quintina Briscoe, Waldorf, MD (US)

( * ) Notice: Subject to any disclaimer, the term of this patent is extended or adjusted under 35 U.S.C. 154(b) by 342 days.

(21) Appl. No.: 17/579,883

(22) Filed: Jan. 20, 2022

(65) Prior Publication Data

US 2022/0225756 A1 Jul. 21, 2022

Related U.S. Application Data

(60) Provisional application No. 63/140,120, filed on Jan. 21, 2021.

(51) Int. Cl.

| | |
|---|---|
| ***A46B 9/02*** | (2006.01) |
| ***A46B 11/00*** | (2006.01) |
| ***A46B 11/06*** | (2006.01) |

(52) U.S. Cl.

CPC ..... *A46B 11/063* (2013.01); *A46B 9/023* (2013.01); *A46B 11/0065* (2013.01); *A46B 2200/104* (2013.01)

(58) Field of Classification Search

CPC ..... A47L 1/08; A47L 13/16; A46B 9/02
See application file for complete search history.

(56) References Cited

U.S. PATENT DOCUMENTS

| | | | | |
|---|---|---|---|---|
| 10,455,996 | B1 * | 10/2019 | Khubani | A47L 1/15 |
| 10,898,930 | B1 * | 1/2021 | Garcia | A47L 13/16 |
| 2004/0265042 | A1 * | 12/2004 | Chan | A47L 1/08 401/270 |

* cited by examiner

*Primary Examiner* — Michael D Jennings
(74) *Attorney, Agent, or Firm* — Rita K. Sinha-Marsh

(57) ABSTRACT

The present invention is directed to a multi liquid dispensing brush, specifically, a hairbrush that has the ability to dispense multiple liquids simultaneously. There are occasions in which one liquid is not sufficient for a consumer; particularly when the consumer desires to detangle and style his or her hair using only one hairstyling tool. Hair care can become a cumbersome process when a consumer attempts to maneuver multiple brushes along with multiple containers of liquids. Depending on a consumer's hair needs, one hairbrush that can dispense multiple liquids from multiple surfaces would eliminate the hassle of needing to constantly switch hairstyling tools, and it would enable the consumer to achieve his or her desired hairstyling results through the usage of this one all-encompassing tool.

14 Claims, 5 Drawing Sheets

MULTI LIQUID DISPENSING BRUSH

CROSS REFERENCES TO RELATED APPLICATIONS

The present application claims the benefit of U.S. Provisional Patent Application Ser. No. 63/140,120, filed on Jan. 21, 2021, and titled "MULTI LIQUID DISPENSING BRUSH," the disclosure of which is incorporated herein by reference in its entirety.

TECHNICAL FIELD

The present technology is related to liquid dispensing hairbrushes, systems, and associated devices. In particular, various embodiments of the present technology are related to liquid dispensing hairbrushes with removable liquid containers.

BACKGROUND OF INVENTION

The beauty industry, specifically the hair care industry, involves skilled professionals who provide hairstyling services to consumers in public venues such as salons, barbershops and day spas. Outside of these venues, consumers have long been able to purchase commercial hair care products to achieve the same hairstyling goals at home. One such product is a hairbrush, a handle brush with rigid or soft bristles that can be used for smoothing, styling and detangling human hair, animal hair, or animal fur. In addition to the hairbrush, a number of hairstyling liquids (i.e. hair cosmetics including conditioners, styling gels, styling sprays, oils, etc.) are used by consumers at home. Contingent on a consumer's hair texture and desired hairstyling goals, the process of hair care may require several of these liquids. Accordingly, some consumers may find themselves surrounded and overwhelmed by multiple containers of liquids, multiple hairbrushes, and multiple other hairstyling tools, all to engage in a time consuming and laborious process of hair care.

While there are liquid-dispensing hairbrushes in the prior art that effectively eliminate the need for a separate container of liquid, there are limitations that exist with such hairbrushes. Existing liquid-dispensing hairbrushes do not accommodate consumers that may require several hairstyling liquids; Nor do they accommodate the need for these liquids to be dispensed through varying bristle patterns on a hairbrush, which may be necessary due to hair texture, hair styling, or hair maintenance needs. For consumers with such needs, once again, they may find themselves surrounded and overwhelmed by multiple containers of liquid and/or multiple liquid-dispensing hairbrushes, all to engage in a laborious process of hair care. Therefore, it is advantageous to alleviate this burden by developing a single hairbrush apparatus that can provide a consumer with the ability to dispense multiple liquids through varying bristle patterns of one hairbrush.

SUMMARY OF INVENTION

The multi liquid dispensing hairbrush of the present invention externally resembles existing hairbrushes, such that, it has a handle and a brush head with bristles. Internally, this hairbrush further comprises a piping system, which runs through the longitudinal axis of the hairbrush, consisting of multiple interconnections of liquid containers and tubes. Sliders on the handle are designed to interact with each of these interconnections. As a slider moves along the length of the handle, it can facilitate the transportation of a liquid through the hairbrush. Ultimately, it can dispense the liquid through a dispensing hole that is embedded within the bristles on the brush head.

In the preferred embodiment, the hairbrush is triangular in shape, externally having three surface areas, three sliders, and three dispensing holes; and internally having three liquid containers and three tubes. As an initial step, a user fills each liquid container with a hairstyling liquid (i.e. any hair cosmetic, including conditioners, styling gels, styling sprays, or oils), enabling three different liquids to be transported through this hairbrush. By sliding each of the three sliders, a user can dispense these three liquids out of the three dispensing holes. It should be noted that the preferred embodiment contains two patterns of bristles providing a user flexibility for hairstyling needs. For example, one preferred detangling liquid can be dispensed from the dispensing hole that is embedded within the bristles best patterned for detangling. Similarly, two preferred styling liquids can be dispensed from the dispensing holes that are embedded within the bristles best patterned for styling, enabling a combination of two liquids to be used for hairstyling.

In other embodiments, the hairbrush can be of any shape and can have any plurality of sliders, liquid containers, tubes, holes, and bristle patterns.

BRIEF DESCRIPTION

DETAILED DESCRIPTION

Figure 1:
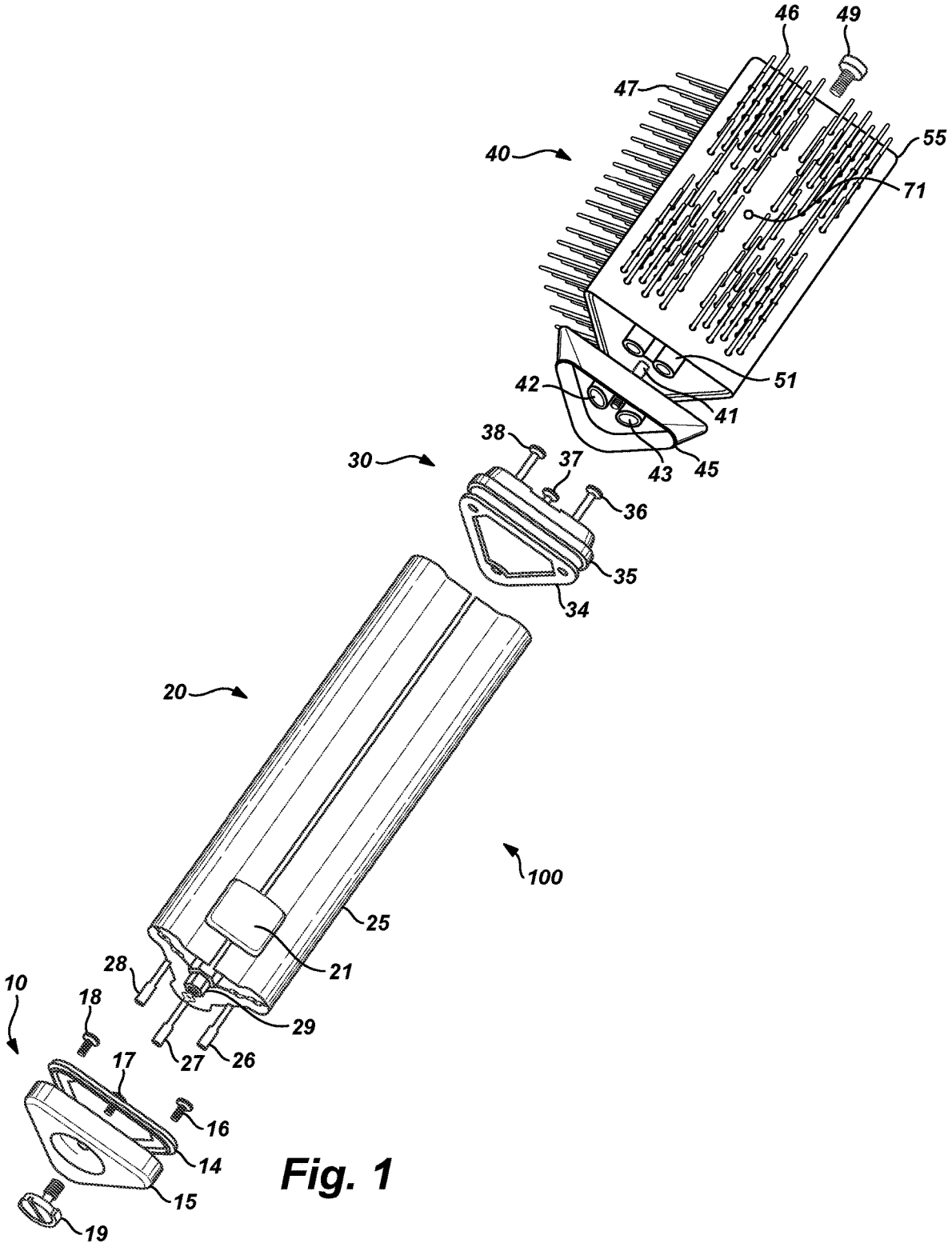
FIG. 1 is an exploded front view of the external components of a multi liquid dispensing brush.

FIG. 1 is an exploded front view of the external components of a multi liquid dispensing brush assembly 100 constructed in accordance with the invention. The multi liquid dispensing brush assembly 100 contains four main components. These four components as shown are: a removable base assembly 10, a handle assembly 20, an anchor assembly 30, and a brush head assembly 40. In the current embodiment, components 20, 30, and 40 are not detachable once constructed, as they are designed to be permanently mated to each other. However, the base assembly 10 is designed to be easily detachable from the handle assembly 20 by a user. In other embodiments, each of these components may be detachable from one another, enabling a user to detach and reattach each component as needed.

The base assembly 10 includes a base 15 and a base plate 14. The base 15 and the base plate 14, shown as triangular in shape, are attached at three corner points via three screws 16, 17, and 18. Once constructed, the base 15, the base plate 14, and the corresponding screws 16, 17, and 18 are permanently mated and are not detachable by a user. In the center of the base 15 is a D-Ring screw 19 which joins with center beam 29. The D-Ring screw 19 facilitates the connection and the removal of the base assembly 10 from the handle assembly 20, as a user can screw and unscrew the D-Ring screw 19 from the center beam 29. While a D-Ring screw is used in the current embodiment, any attachment device may be used to facilitate this purpose of easy attachment and detachment of the base assembly 10 from the handle assembly 20, by a user.

Figure 2:
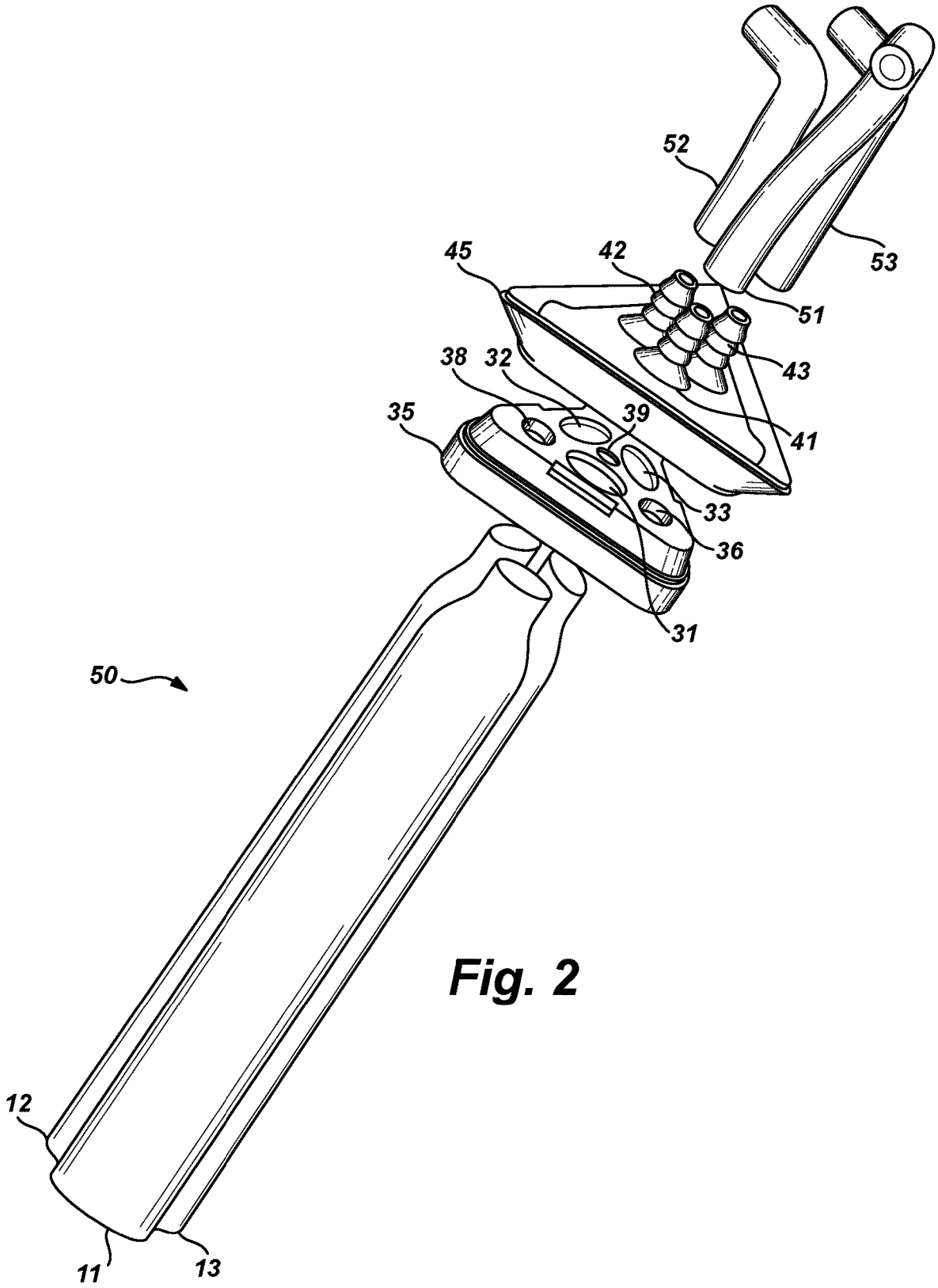
FIG. 2 is an exploded view of the internal piping system of the multi liquid dispensing brush.

The handle assembly 20 includes the handle 25, an external casing, which houses liquid containers that are further depicted in FIG. 2. Running internally along the longitudinal axis of handle 25 is the center beam 29. On a first surface of handle 25 is a slider 21, which is one of three sliders, that slides up and down the length of the handle. The bottom of the handle assembly has three locking pins 26, 27, and 28, which are an intricate component of an internal piping system, as further explained in FIG. 6. In the current embodiment, the handle is triangular in shape with three surfaces. As such, there are three sliders located on each of the three surfaces, respectively. In other embodiments, this handle can be constructed as any suitable shape that will accommodate two or more sliders.

The anchor assembly 30 includes an anchor 35 and an anchor plate 34. The anchor 35 and the anchor plate 34, shown as triangular in shape, are attached to each other and to the handle 25 at three corner points via three screws 36, 37, and 38. Once constructed, the anchor 35, the anchor plate 34, the handle 25, and the corresponding screws 36, 37, and 38 are not detachable by a user.

The brush head assembly 40 includes the brush head 55, which is shown as triangular in shape having three faces. A first face contains a first pattern of bristles 46, which is a preferred bristle pattern used for detangling hair. Also depicted on the first face is a dispensing hole 71 embedded in the center of the first pattern of bristles 46. A second face contains a second pattern of bristles 47, which is a preferred bristle pattern used for styling hair. There are two dispensing holes embedded in this second pattern of bristles, which are further depicted in FIG. 7. The bottom surface of the brush head is formed by a pedestal 45, which contains three spokes 41, 42, and 43. Depicted in this figure is the bottom of spokes 42 and 43, and the top of spoke 41. The spokes are positioned to be housed inside of the brush head. Further shown is a tube 51, which connects with spoke 41, and is one of three tubes that mate with each of the three spokes. These tubes and spokes are all positioned inside of the brush head, as a part of an internal piping system that is further depicted in FIG. 2. The center beam 29 runs internally along the longitudinal axis of the components 20, 30 and 40, and is permanently connected on its one end to the brush head 55 by a top screw 49.

In the current embodiment, the brush head is triangular in shape, with three faces that have two distinct patterns of bristles amongst them. In another embodiment, this brush head can remain triangular in shape, and rather than two, it can have either one or three distinct patterns of bristles. In further embodiments, the brush head can be formed in any shape other than triangular. In any of these embodiments, the brush head must have two or more dispensing holes amongst its face or faces.

FIG. 2 is an exploded view of the internal piping system 50 of the multi liquid dispensing brush. As was described in FIG. 1, the anchor 35 and its face plate are permanently joined to one another via screws 36, 37 (not shown in this Figure), and 38.

Further disclosed in this Figure is the internal path through which a liquid is transported through the brush assembly and dispensed, beginning with the three liquid containers 11, 12, and 13. These liquid containers are removable by a user, and can be filled and refilled with any liquid of choice. The anchor 35 has three holes 31, 32, and 33, each of which receive the liquid containers 11, 12, and 13. Pedestal 45 has three spokes 41, 42, and 43. The bottom of each spoke connects to each of the holes 31, 32, and 33, respectively. Similarly, the top of each spoke mates to each of three tubes 51, 52, and 53, respectively.

In operation, the piping system transports and dispenses liquid through the multi liquid dispensing brush as follows: The liquid container 11 is filled with a first liquid by a user. This first liquid travels through the liquid container 11, through the hole 31, and into spoke 41. Upon entrance into spoke 41, the first liquid continues travels into the bottom end of tube 51, until it is finally dispensed from the top end of tube 51. This process occurs similarly for the second liquid that travels through liquid container 12, hole 32, spoke 42, and tube 52, as well as, the third liquid that travels through liquid container 13, hole 33, spoke 43, and tube 53. Each tube 51, 52, and 53 corresponds with a hole on a face of the brush head, thus completing the transportation of the liquids through the internal piping system and dispensed through a hole on the brush head.

Figure 3:
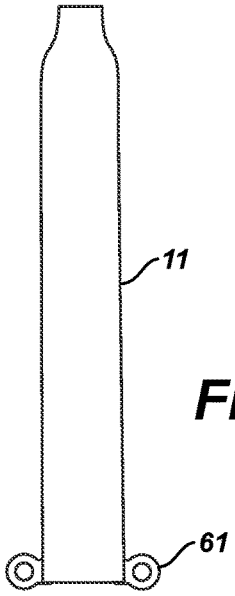
FIG. 3 is a front perspective view of a liquid container in its open position.

FIG. 3 is a front perspective view of a liquid container in its open position. As the liquid container is removable from the handle, this Figure depicts the liquid container outside of the multi liquid dispensing brush. Shown with liquid container 11 is its corresponding clip 61, which is a rectangular shaped plastic having two circular ends with holes. While in its open position, the clip remains parallel with the body of the liquid container 11, specifically parallel with the mouth of the liquid container. In this open position, the liquid can be filled into the liquid container 11 from its open end, or its mouth, while the other end of the liquid container will be received by a hole in the anchor.

Figure 4:
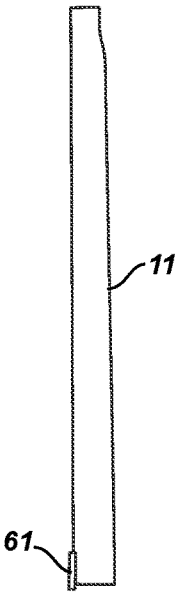
FIG. 4 is a side perspective view of the liquid container in its open position.

FIG. 4 is a side perspective view of a liquid container in its open position. As the liquid container is removable from the handle, this Figure depicts the liquid container outside of the multi liquid dispensing brush. Shown with liquid container 11 is its corresponding clip 61. While in its open position, the clip remains parallel with the body of the liquid container 11, specifically parallel with the mouth of the liquid container. In this open position, the liquid can be filled into the liquid container 11 from its open end, or its mouth, while the other end of the liquid container will be received by a hole in the anchor.

Figure 5:
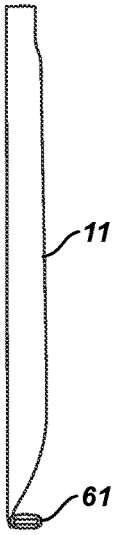
FIG. 5 is a side perspective view of the liquid container in its closed position.

FIG. 5 is a side perspective view of the liquid container in its closed position. As the liquid container is removable from the handle, this Figure depicts the liquid container outside of the multi liquid dispensing brush. Shown with liquid container 11 is its corresponding clip 61. While in its closed position, the clip 61 repositions and becomes perpendicular with the body of the liquid container 11, thereby sealing the mouth of the liquid container closed. By sealing this liquid container, a user can be assured that the liquid will not leak from the first end of the liquid container, but that it will continue down its path of travel through the other end of the liquid container.

Figure 6:
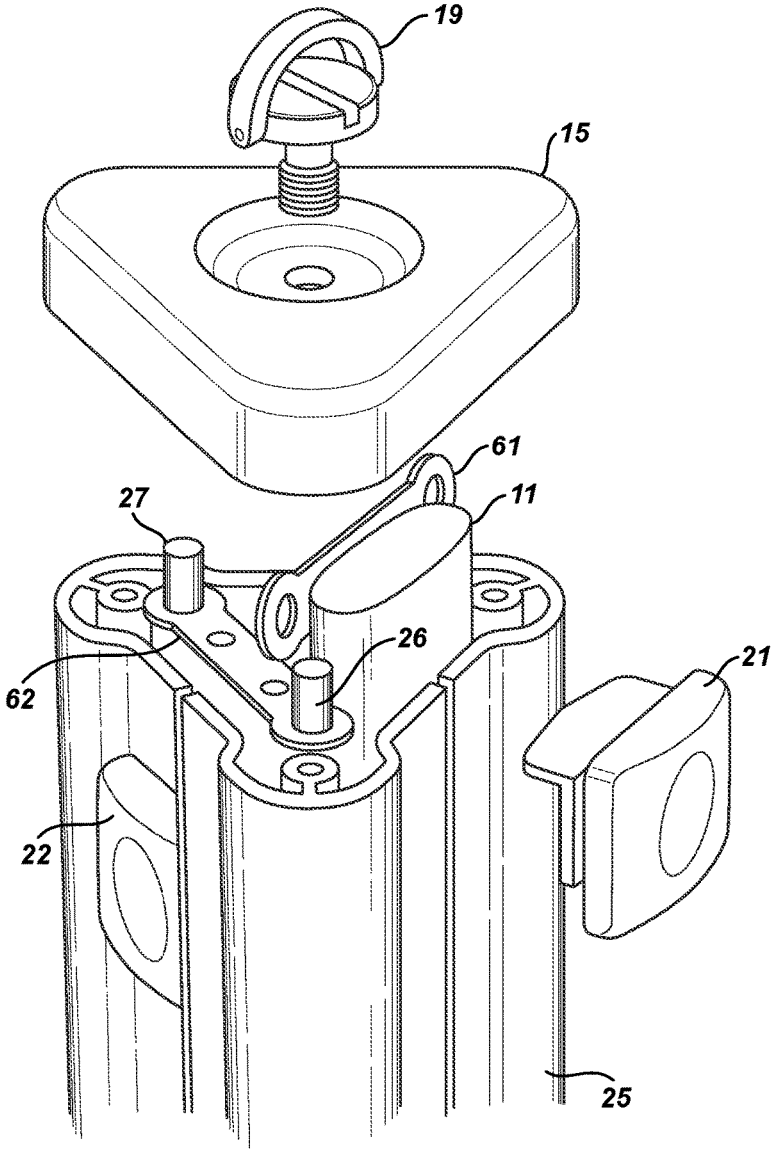
FIG. 6 is an exploded view of the connection point between the base and the handle, in which the liquid container is shown inserted into the handle.

FIG. 6 is an exploded view of the connection point between the base 15 and the handle 25, in which the liquid container 11 is shown inserted into the handle. The D-Ring screw 19 facilitates the removal of the base 15 from the handle 25. By removing the base, a user can gain access to any of the liquid containers and proceed with filling and refilling the liquids. In operation, the liquid container 11 is removed from the handle 25 such that a user fills the liquid container with any liquid of choice. Once reinserting liquid container 11 into the handle, the clip 61 is repositioned to flip down and become perpendicular with liquid container 11 (as was shown in FIG. 5). In this perpendicular position, the two circular ends of the clip 61 interlock with locking pins 26 and 28 (Locking pin 28 is not shown in this figure), thereby closing the mouth of the liquid container and sealing it to prevent the spillage of the liquid. After the liquid container is closed, a user can move the slider 21 down the length of the handle, and the slider will compress liquid container 11. The process of transporting the liquid through the internal piping system, as was described in FIG. 2, is initiated.

Similarly, liquid container 12 (not shown in this Figure) is already inserted into the handle 25. Its clip 62 is already in the perpendicular position and its two circular ends are interlocked with locking pins 26 and 27. The slider 22 abuts under clip 62, and as slider 22 slides down the handle 25, the process of transporting the second liquid through the second liquid container is also initiated.

Figure 7:
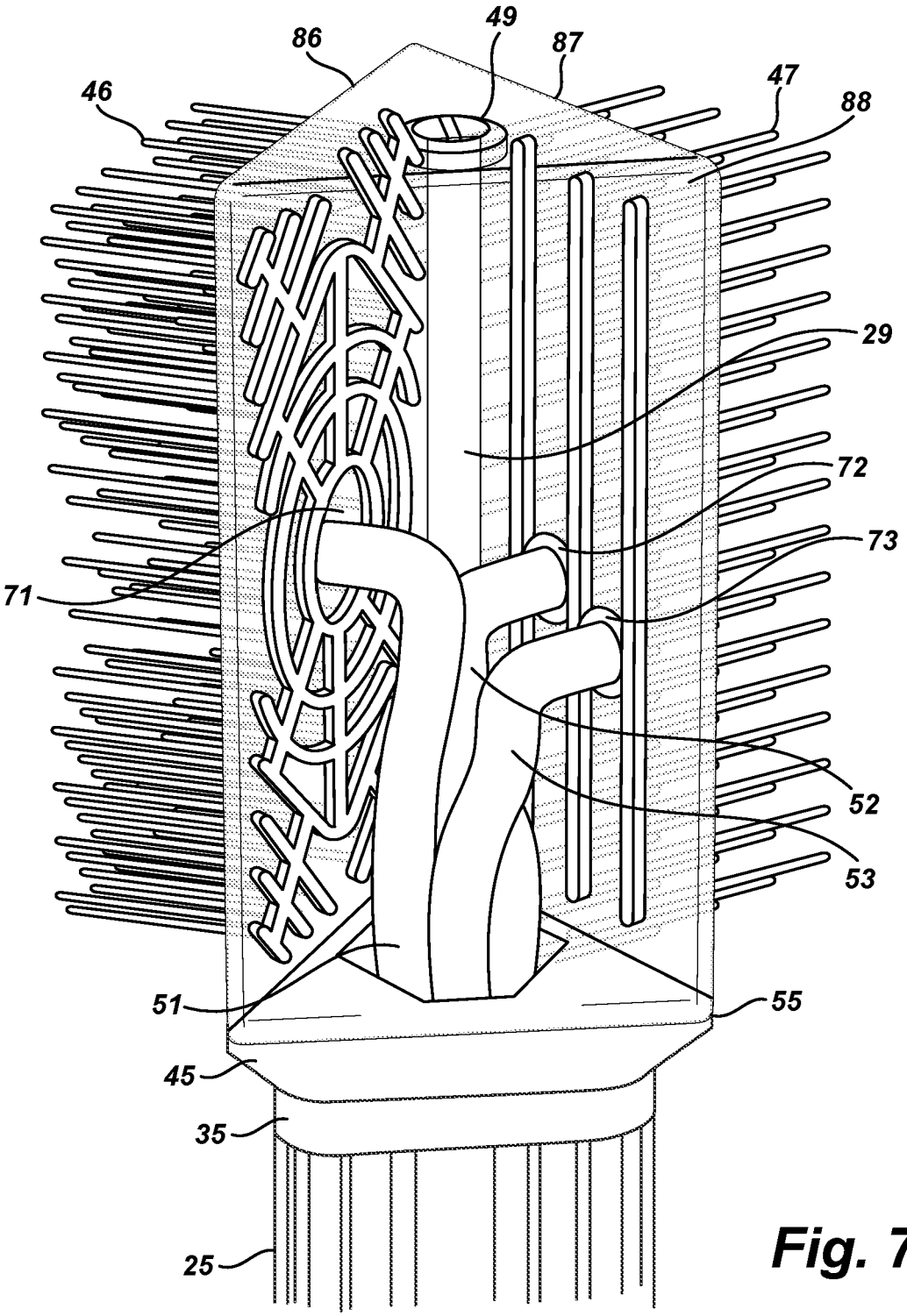
FIG. 7 is a front cross sectional view of the brush head depicting the internal piping system.

FIG. 7 is a front cross sectional view of the brush head depicting the internal piping system. The brush head 55 is triangular in shape and has three faces 86, 87, and 88. Face 86 contains bristles 46 and one hole 71, to which tube 51 is connected. The liquid from tube 51, after transporting through the internal piping system, is dispensed from hole 71. Face 87 contains bristles 47 and two holes 72 and 73. The liquid from tube 52, after transporting through the internal piping system, is dispensed from hole 72. The liquid from tube 53, after transporting through the internal piping system, is dispensed from hole 73. Face 88 contains no bristles and no holes.

In operation, a user that desires a combination of multiple liquids for the purposes of detangling hair and styling hair, will benefit from the versality provided by this brush. Using the first bristle pattern 46, and the first liquid dispensed from tube 51, a user can detangle his or her hair. Then using the second bristle pattern 47, and the combination of the second and third liquids dispensed from tubes 52 and 53, a user can style his or her hair.

As described in previous figures, the foundation of the brush head 55 is supported by pedestal 45, which is permanently mated to the anchor 35 and the handle 25. Top screw 49 holds center beam 29 in place as it runs through the longitudinal axis of the brush providing stability and support to the entire brush assembly.

Figure 8:
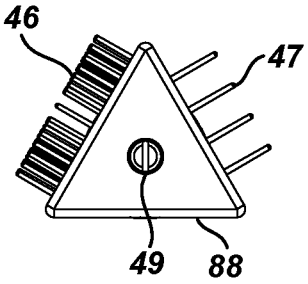
FIG. 8 is a top cross sectional view of the brush head.

FIG. 8 is a top cross sectional view of the brush head. The top screw 49 is shown in the center of the triangular shaped brush head. In this view, face 88 is on the bottom and shown without bristles. The remaining two faces depict bristles 46 and 47 as having distinct bristle patterns, to accommodate the needs of detangling and styling hair respectively.

Figure 9:
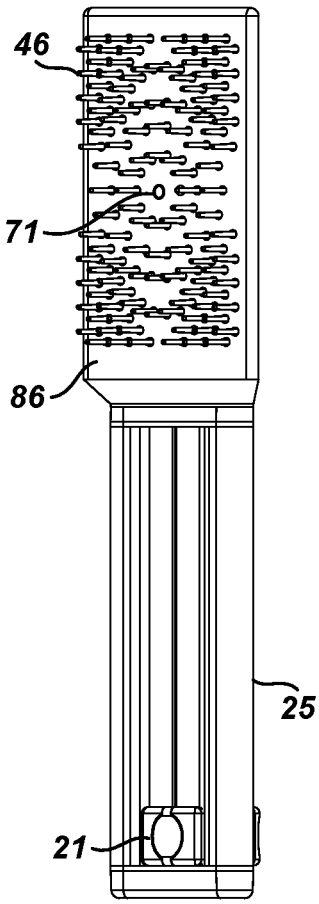
FIG. 9 is a front perspective view of one side of the multi liquid dispensing brush.

FIG. 9 is a front perspective view of one side of the multi liquid dispensing brush. Shown is face 86 containing bristles 46 and the singular hole 71. The handle 25 is shown with the slider 21. As previously disclosed, in operation, a user can slide the slider 21 along the length of handle, thereby controlling the transportation of the first liquid through the internal piping system and ultimately dispensing that liquid out of hole 71. In the current embodiment, the pattern of bristles 46 are specifically patterned to accommodate the needs of detangling hair.

Figure 10:
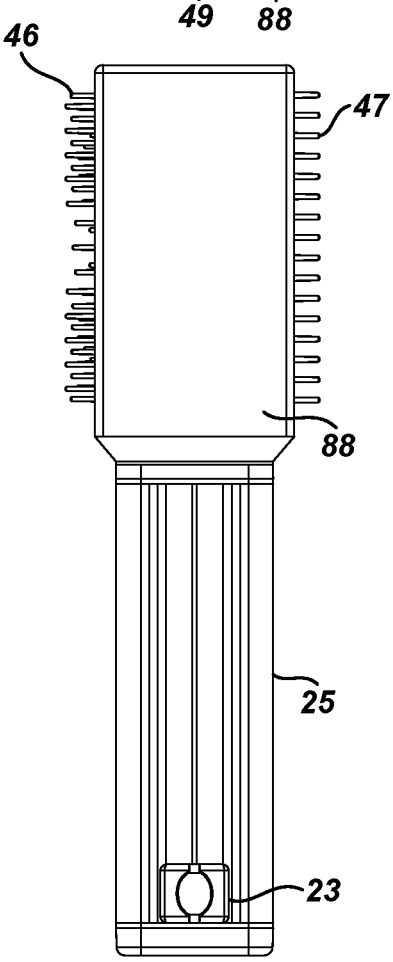
FIG. 10 is a front perspective view of another side of the multi liquid dispensing brush.

FIG. 10 is a front perspective view of another side of the multi liquid brush. Shown is face 88 containing no bristles. However, the side views of bristles 46 and 47 are shown. A slider 23 is also shown. As previously disclosed, in operation, a user can slide the slider 23 along the length of handle, thereby controlling the transportation of the second liquid through the internal piping system and ultimately dispensing that liquid out of a hole 73. Hole 73 is depicted in FIG. 11 as it is located on face 87.

Figure 11:
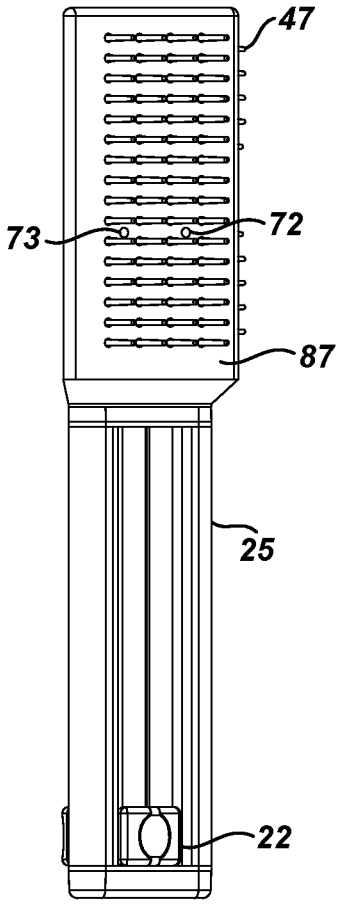
FIG. 11 is a front perspective view of another side of the multi liquid dispensing brush.

FIG. 11 is a front perspective view of another side of the multi liquid brush. Shown is face 87 containing bristles 47 and two holes 72 and 73. The handle 25 is shown with the slider 22. As previously disclosed, in operation, a user can slide the slider 22 along the length of handle, thereby controlling the transportation of the third liquid through the internal piping system and ultimately dispensing that liquid out of hole 72.

In the current embodiment, the pattern of bristles 47 are specifically patterned to accommodate the needs of styling hair, while the two holes 72 and 73 accommodate the dispensing of a combination of two liquids for this styling process.

As previously discussed, the liquid dispensed out of hole 73 is controlled by slider 23, which is shown in FIG. 10.

Figure 12:
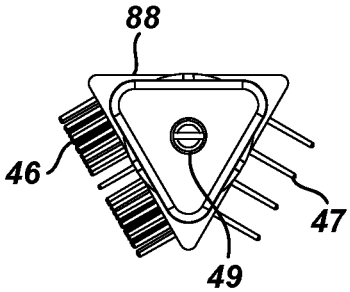
FIG. 12 is a top cross sectional view of the brush head.

FIG. 12 is a top cross sectional view of the brush head. The top screw 49 is shown in the center of a triangular shaped brush head. In this view, face 88 is on the top and shown without bristles. The remaining two faces depict bristles 46 and 47 as having distinct bristle patterns, to accommodate the needs of detangling and styling hair respectively.

In the current embodiment, the length of the brush is approximately 11 inches, while the width of the brush head is 2.5 inches. Additionally, the external components of the multi liquid dispensing brush are constructed of a plastic material, while the liquid containers and tubes are constructed of silicone.

For this multi liquid dispensing brush, the components of the brush, the liquid containers, and the tubes can be constructed of any material having similar or more proficient properties that are well known to those skilled in the art to be used safely for hairbrushes. The components of this invention can vary in range of height, length, width and weight, as well as, in thickness and in size. Further, it can be made in any preferred color or design, customizable or pre-printed. Although the present invention has been described with reference to specific exemplary embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

The invention claimed is:

1. A multi liquid dispensing brush comprising:

a removable base;

a handle;

an anchor having two or more apertures cutting through a top surface and a bottom surface of said anchor;

a brush head having a pedestal as its foundation wherein the pedestal has two or more spokes on its top surface;

the brush head having two or more faces with two or more apertures on said faces;

a center beam;

a piping system having two or more liquid containers, and two or more tubes;

wherein the handle, the anchor, and the brush head are permanently mated together with the top surface of the anchor mated to the pedestal and the bottom surface of the anchor mated to the handle;

wherein the piping system runs internally through the longitudinal axis of the handle, the anchor, and the brush head such that the two or more liquid containers are positioned inside of the handle and the two or more tubes are positioned inside of the brush head;

wherein the center beam runs internally through the longitudinal axis of the piping system and on its first end is permanently mated to the top of the brush head with a first attachment device.

2. The multi liquid dispensing brush of claim 1 further comprising the handle having two or more sliding components that are slidable along the length of the handle.

3. The multi liquid dispensing brush of claim 2 wherein the two or more liquid containers are removable from the brush and fillable with two or more liquids.

4. The multi liquid dispensing brush of claim 3, wherein the two or more sliding components are manually operable to drive the two or more liquids within the two or more liquid containers through the two or more apertures on the face of the brush head.

5. The multi liquid dispensing brush of claim 3, wherein each liquid container further comprises:

a body having a mouth, a tab attached to the mouth's edge, wherein the body defines a chamber configured to contain a liquid, and when in an open position, the tab rests parallel with the mouth, but when in a closed position, the tab shifts into a perpendicular position with the mouth.

6. The multi liquid dispensing brush of claim 5, wherein each sliding component abuts each tab while in the perpendicular position, and as each sliding component slides along the length of the handle, each sliding component drives the transfer of each liquid through each liquid container, through each aperture in the anchor, through each spoke on the pedestal, through each tube, and through each aperture on the face of the brush head.

7. The multi liquid dispensing brush of claim 6, wherein each sliding component engages with its own pipeline consisting of the liquid container, the aperture in the anchor, the spoke on the pedestal, the tube, and the aperture on the face of the brush head.

8. The multi liquid dispensing brush of claim 3, further comprising two or more interconnections of: the liquid container, the aperture in the anchor, the spoke on the pedestal, the tube, and the aperture on the face of the brush head, wherein each liquid is transferred within each interconnection through the liquid container, through the aperture in the anchor, through the spoke on the pedestal, through the tube, and through the aperture on the face of the brush head.

9. The multi liquid dispensing brush of claim 8, wherein the spoke on the pedestal is a male connector and the tube is a female connector such that the tube is configured to mate with the spoke creating an airtight seal between the tube and the spoke.

10. The multi liquid dispensing brush of claim 1, wherein the removable base further comprises a second attachment device used to attach the removable base to the second end of the center beam operably connecting the removable base to the handle.

11. The multi liquid dispensing brush of claim 10, wherein the second attachment device can detach the removable base from the second end of the center beam operably detaching the removable base from the handle and enabling access to the liquid containers.

12. The multi liquid dispensing brush of claim 1, wherein the two or more faces of the brush head further comprise two or more bristle patterns.

13. The multi liquid dispensing brush of claim 1, wherein the brush has a triangular top cross section.

14. The multi liquid dispensing brush of claim 1, wherein the two or more liquid containers and the two or more tubes are constructed of silicone material.

* * * * *